US005471919A

United States Patent [19]

Dabizzi

[11] Patent Number: 5,471,919

[45] Date of Patent: Dec. 5, 1995

[54] AUTOMATIC BALING PRESS WITH TWO CASES ROTATABLE ON A CAROUSEL

[75] Inventor: Valerio Dabizzi, Vaiano, Italy

[73] Assignee: Dabizzi Valerio & C. S.n.C., Vaiano, Italy

[21] Appl. No.: 90,774

[22] Filed: Jul. 13, 1993

[51] Int. Cl.[6] ..... B65B 13/00

[52] U.S. Cl. ..... 100/7; 100/14; 100/215; 100/218; 100/223; 100/232

[58] Field of Search ..... 100/7, 14, 17, 100/18, 19 R, 26, 215, 218, 221, 223, 232, 249

[56] References Cited

U.S. PATENT DOCUMENTS

| | | | |
|---|---|---|---|
| 664,882 | 1/1901 | Morgan | 100/223 X |
| 679,732 | 8/1901 | Dederick | 100/223 X |
| 1,395,041 | 10/1921 | Coe | 100/223 X |
| 3,352,233 | 11/1967 | Lalonde et al. | 100/223 X |
| 4,476,779 | 10/1984 | Hasebe et al. | 100/7 |

FOREIGN PATENT DOCUMENTS

| | | | |
|---|---|---|---|
| 138490 | 7/1961 | U.S.S.R. | 100/223 |

*Primary Examiner*—Stephen F. Gerrity
*Attorney, Agent, or Firm*—McGlew and Tuttle

[57] ABSTRACT

Automatic baling press including a plurality of vertical cases 12, intermittently rotating in carousel fashion, with continuous feed device 5 and automatic binding device 18. The cases 12 are open on the top and bottom and rotate by grazing an underlying horizontal fixed plane 6. The fixed plane or plate is provided with an aperture 21 in the pressing region. A cylinder 10 having a vertical axis is provided whose head 11 is intended to fit precisely into the case 12. The pressing station is provided with a horizontal prismatic caisson 7 with an aperture 20 equal and juxtaposed to the aperture 21 of the plane 6. The caisson has a head 15 which is axially movable. A gate 16 is transversely movable to delimit a pressing chamber 24. The caisson has a mouth for the unloading of the bales and is provided with automatic binding means 8 which are fixed.

11 Claims, 3 Drawing Sheets

AUTOMATIC BALING PRESS WITH TWO CASES ROTATABLE ON A CAROUSEL

FIELD OF THE INVENTION

The present invention refers in general to an automatic baling press, and in particular to a press with continuous feeding of the material to be treated and automatic binding of the pressed bales.

BACKGROUND OF THE INVENTION

It is known that in order to press many types of continuously fed materials such as textiles, solid waste and other, in the form of bales and to increase the production of the outputting bales, presses are used which are provided with two vertical cases that are connected to each other. The cases are liftable and rotatable about a central axis of a bearing structure so as to take up two positions. One position is for loading and the other position is for pressing. Afterwards, the filled case is pushed upwards for binding by utilizing channels provided in the platforms.

In these known presses, the pressing platform has dimensions corresponding to the internal dimensions of the cases and the pressing platform is positioned on top of the case in the second position. The two cases are closed at the bottom by a platform solid to the cases.

During the rotation, the cases are released. During the pressing, the cases remain stationary on the bearing structure which withstands the pressing force.

In addition, these presses are mostly provided with automatic binding devices which have the function of passing, tensioning and binding the straps, but the binding devices currently known, owing to the demand for a binding of high precision and reliability, have a very high cost and a relatively long binding cycle. This is especially true when a large number (6 to 12 and more) of straps are to be applied and when the need arises to bind the bales both longitudinally and transversely.

Besides, in the baling presses currently known, the presence of two individually sliding and jointly liftable cases is cause for a complex and costly construction. Especially when it uses more binding heads for an improved distribution of the times for the various operations carried out by the press. Operations ranging from the loading of the material to be baled, to the final binding of the pressed bale.

SUMMARY AND OBJECT OF THE INVENTION

The present invention had the object of eliminating the above mentioned drawbacks and proposing an automatic baling press with a vertical axis and carousel-like rotating cases. The present invention is also designed for high production, limited cost, and is suitable for bales even of large size and, therefore, working under high pressure.

This result has been achieved, according to the invention, by providing a press made up of a structure carrying at least two equal vertical cases, open on top and at the bottom, and solid to each other. The cases are angularly equidistant and carousel-like rotating about a vertical axis, with an intermittent motion between a loading position and a pressing position. A hopper is provided for feeding the material to be pressed and the hopper is located above the case which is in the loading position. A horizontal plane is fixed to the bearing structure and located in such a position as to graze the base of the cases. The horizontal plane is provided with an aperture in correspondence of the pressing region. A prismatic caisson having horizontal development, rectangular cross-section, is open at one end and fixed to the bearing structure. The caisson is provided with a port for the input of the material in correspondence with the pressing chamber. A head is movable in a longitudinal direction inside the pressing caisson and a gate is movable transversely to the caisson for delimiting a material-pressing chamber and pushing the pressed bale forward. A pressing cylinder with a compression head performs a reciprocating vertical run in line with the case that is in the pressing position. Means are also provided for the automatic binding of the bales outputting or ejecting from the caisson.

The advantages obtained from the present invention lie essentially in the high reliability due to the absence of movements such as the sliding of the cases and the lifting and the rotation of the platforms. Other advantages are: a high operational speed even for bales of large dimensions and under very high pressures; a reduced binding time in spite of using a single head located in correspondence of the output mouth; the possibility of using the press for loose materials of very reduced sizes such as fibers, rice straw, paper, powders, or liquid-holding materials such as garbage waste; a high degree of cleanness around the press, even in case of polluting material, thanks to the possibility of discharging the liquids and the like; the possibility of weighing the material prior to the loading by means of a belt conveyor mounted on a weigh scale; the possibility of automatically transporting the output, or ejected, bales while possibly weighing and labeling them, as well as baling them with heat-removable film, as required; and the fully automatic control of the whole operating cycle through a simple logic programmer.

BRIEF DESCRIPTION OF THE DRAWINGS

These and other advantages and characteristics of the invention will be best understood by anyone skilled in the art from a reading of the following description in conjunction with the attached drawings given as a practical exemplification of limitative sense, wherein.

DETAILED DESCRIPTION OF THE PREFERRED EMBODIMENT

Figure 1:
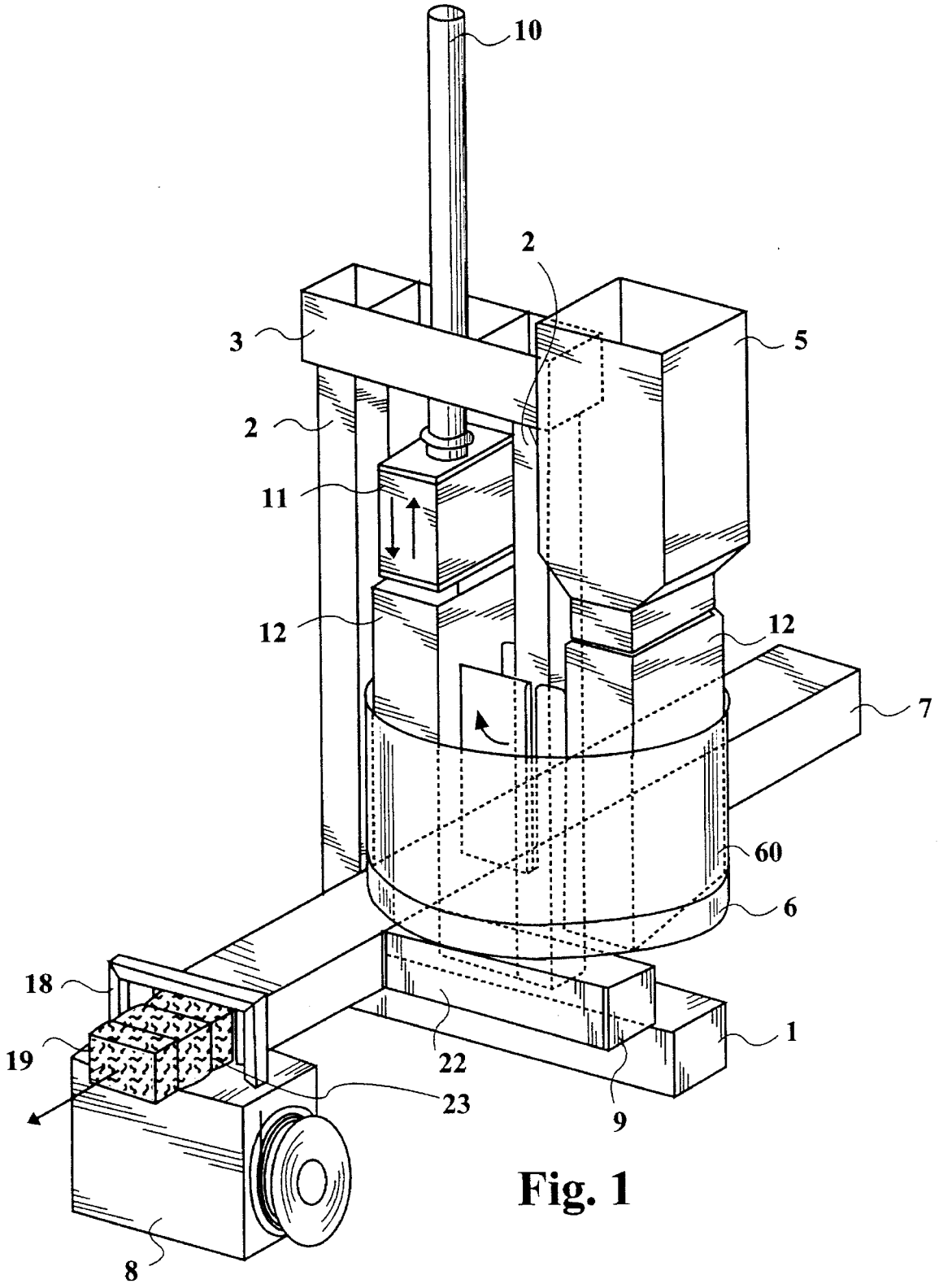
FIG. 1 is a perspective view of a press according to the invention in a first preferred embodiment thereof.
Figure 2:
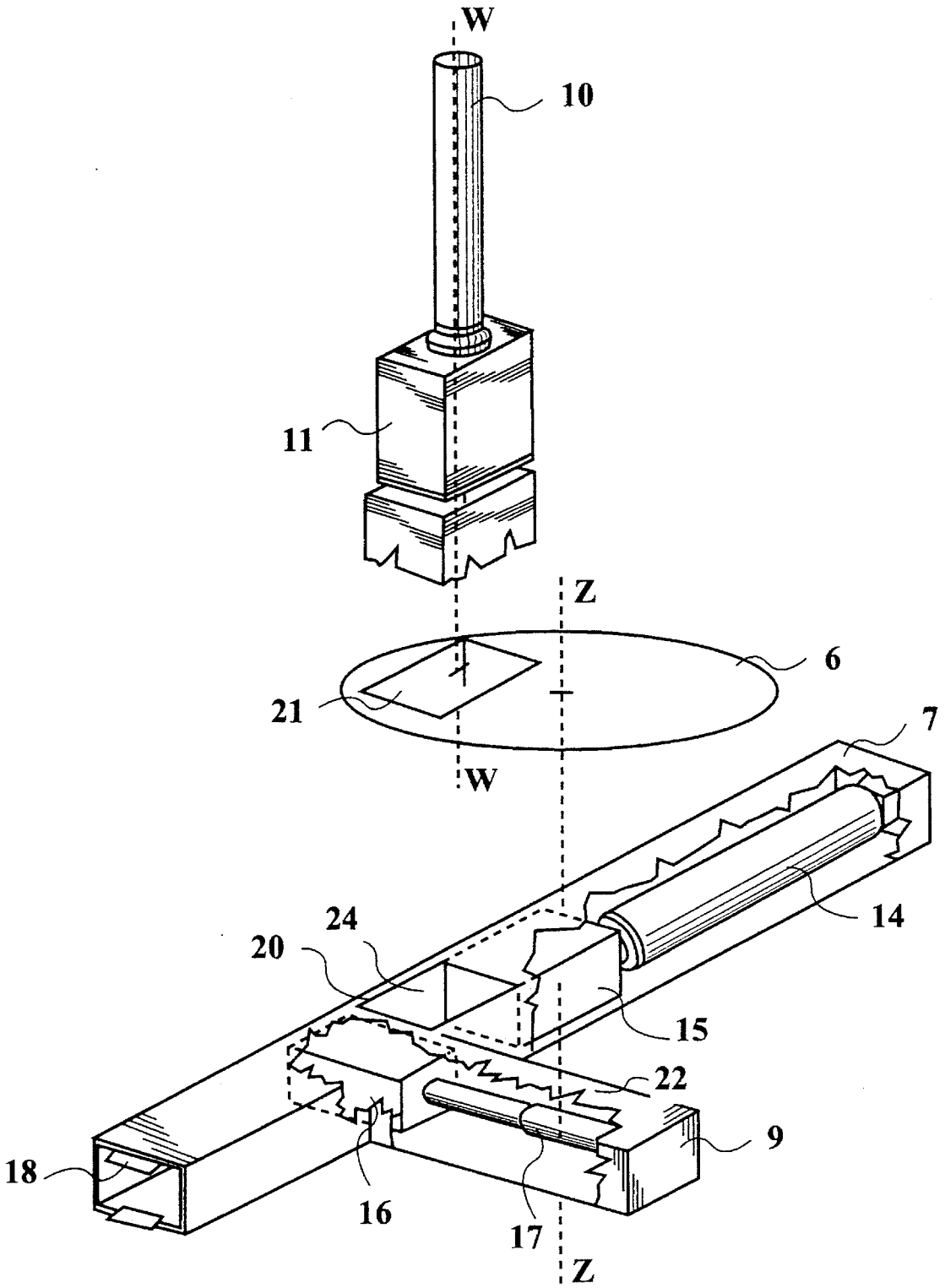
FIG. 2 is a perspective view of the members for the formation of the fill chamber and for the expulsion of the pressed material by the press of FIG. 1.

Reduced to its basic structure, and reference being made to FIGS. 1 and 2 of the attached drawings, an automatic baling press according to the invention has at least two vertical cases 12 rotating solid to each other in a carousel fashion and intermittently about a vertical axis z—z. A hopper means 5 is provided for feeding the material to be pressed and means 8 is also provided for the automatic binding of the bales 19 after the pressing. A bearing structure with a base 1 and two posts 2 is fixed on top to the base 1 and is connected to each other at the bottom by a cross piece 3. A plane or plate 6 is fixed to the base 1 of the bearing structure and grazes the lower port of the case 12. The plate is provided with a plate aperture 21 in correspondence with the pressing region. A bale-packing caisson 7 is fixed to the bearing structure 1 and has a straight, horizontal design with rectangular cross-section. The caisson 7 has a first upper, rectangular aperture 20 for the intake of material to be pressed and a second side aperture 22 in correspondence of which a box-like, horizontal body 9 of rectangular cross-section and of same height as the caisson 7 is perpendicularly fitted.

Provided inside the caisson 7 and driven into reciprocating motion by an operating cylinder 14 is a caisson means 15 for delimiting a pressing chamber 24 and performing the thrust-operated advancement of the pressed bale. A gate 16 is positioned inside the body 9 for cooperating in the delimitation of said pressing chamber and moves through the second aperture 22 of the caisson 7 with a reciprocating motion operated by the cylinder 17. A pressing cylinder or means 10 is vertically mounted at a position overlaying the case 12 which is in the pressing station. The pressing station has a head 1 intended to fit with precision into the case 12 and with a downward run sufficient to compress the material collected therein into the underlying chamber 24 of the caisson 7.

Figure 3:
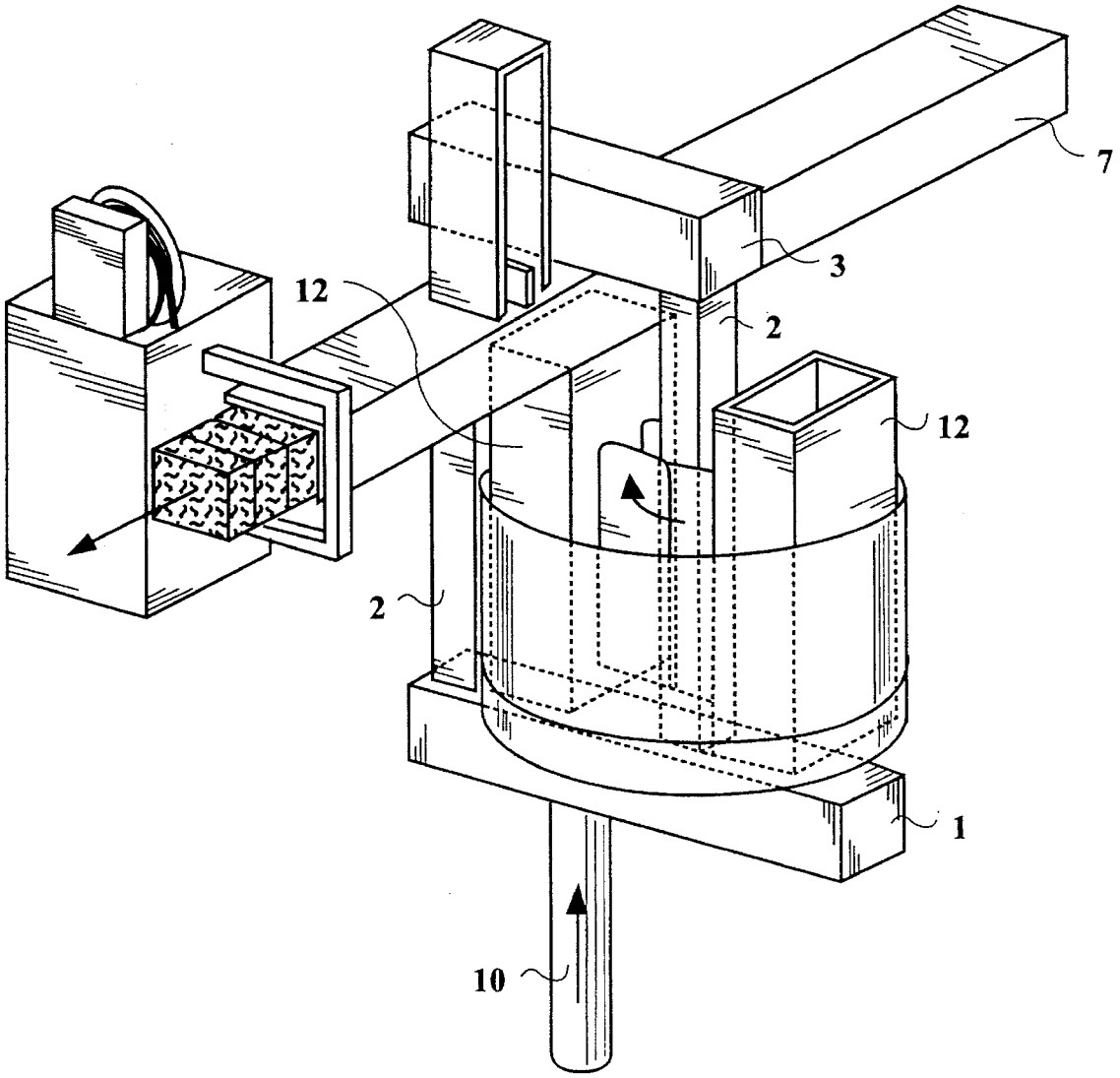
FIG. 3 is the perspective view of a press according to the invention in a second preferred embodiment thereof.

Alternatively and with reference to FIG. 3 of the attached drawings, provision is made, according to the invention, for positioning the pressing cylinder 10 vertically below the caisson 7. In this case, the body with the gate 16 is disposed vertically above, or sideways to, the caisson 7. The latter exhibiting the apertures 20 and 22 in the upper and lower part thereof, respectively.

According to the invention, the plane 6 is provided with a shell 60 of convenient height to allow for the gathering and holding of residual material of small size or possibly of liquid nature coming out of the cases.

A further feature is that the outlet mouth of the caisson 7 is provided with two converging appendixes 18 to achieve a pressure on the outputting bale 19 sufficient to hold the latter in place during its transversal binding by means of a plurality of straps 23. An interspace of the straps is determined by an equal, and intermittently repeated advancement of the head 15.

According to the invention, there is advantageously provided means for controlling the whole operating cycle by means of a logic programmer.

The operation is as follows:

While one of the cases 12 is in the fill position below the hopper 5, the other, already filled with material, is in the unloading position inside the underlying caisson 7 after having gone through the coincident apertures 21, 20.

At this moment, the gate 16 is at the end of the forward run of caisson 7 and the head 15 is at the end of the return run so as to delimit, by the lateral and lower walls of the caisson 7, the filling and pressing chamber 22 and, thereby, the size of the bales 19 to be obtained at the discharge.

Then the head 11 of the pressing cylinder 10 is made to go down into the underlying case 12 and push the material held therein into the chamber 22 of the caisson 7 to definitely press it therein. Upon completion of the compaction, the gate 16 is made to retreat by releasing the compacted material towards the exit of the caisson 7. Thereafter, the head 15 of the cylinder 14 is moved forward as far as to cause the pressed material to project form the mouth of the caisson 7. The head 15 is extended to such an extent as required for applying, by means of an automatic binder 8, a first binding strap 23. At this point, the head 11 is lifted to allow for the next rotation of the cases 12. Depending on the number of the straps 23 to be applied, the base 19 is pushed forwards by the cylinder 14 many times with intermittence and through constant-step advancements.

At the end of the binding operation, the thus bound bale 19 is unloaded off the caisson 7 and the head 15 of the cylinder 14 is made to go back as far as the starting position. At this point, the gate 16 is moved fully onwards and, at the same time, the cases 12 rotate by half a revolution to bring the empty case under the hopper 5 and the filled case on top of the aperture 20.

In case the bales 19 must be sacked, it is sufficient to fit completely the sack down onto the terminal part of the caisson 7 by allowing the latter to fully wrap the bale while pushing it out, with or without the application of binding straps.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

While specific embodiments of the invention have been shown and described in detail to illustrate the application of the principles of the invention, it will be understood that the invention may be embodied otherwise without departing from such principles.

What is claimed is:

1. A baling press comprising:

a rotatable carrousel;

a plurality of cases connected to said carrousel and rotatable with said carousel between a first position and a second position, each of said plurality of cases having an open first end and an open second end;

a fixed plate positioned across said open first end of said plurality of cases, said fixed plate defining a plate aperture adjacent said open first end of one of said plurality of cases when said one of said plurality of cases is in said second position;

hopper means for filling another one of said plurality of cases when said another one of said plurality of cases is in said first position;

a caisson positioned on an opposite side of said fixed plate from said plurality of cases, said caisson defining a first aperture adjacent said plate aperture, said caisson also defining a second aperture and a mouth;

pressing means for pressing material in said one of said plurality of cases when said one of said plurality of cases is in said second position, said pressing means including a head movable into said open second end of said one of said cases to press and to move the material in said one of said cases through said plate aperture and first aperture;

caisson head means for moving the material pressed through said first aperture towards said mouth;

gate means connected to said caisson and for cooperating with said caisson and said caisson head means to define a pressing chamber, said gate means including a gate movable into and out of said caisson through said second aperture;

binding means positioned at said mouth of said caisson and for binding the material moved by said caisson means.

2. Press according to claim 1, wherein:

said caisson is positioned downwardly of said fixed plate.

3. Press according to claim 2 wherein:

said discharge mouth of said caisson is provided with two converging appendixes to cause a bale to be held during the binding step.

4. Press according to claim 1, wherein:

said caisson is positioned upwardly of the corresponding case.

5. A press according to claim 4, wherein:

said discharge mouth of said caisson is provided with two converging appendixes to allow a bale to be held during the binding step.

6. Press according to claim 1, wherein:

said pressing means is positioned overlaying said one of said plurality of cases when said one of said plurality of cases is in said second position.

7. Press according to claim 1, wherein said pressing means is positioned underlying said fixed plate.

8. Press according to claim 1, wherein said caisson head means includes a head engaged to an operating cylinder fixed within said caisson on the side of said caisson opposite said mouth.

9. Press according to claim 8, wherein said operating cylinder moves said head of said caisson head means to push the material pressed inside said pressing chamber beyond said mouth of the caisson with an intermittent advancement equal to a distance between bindings of said binding means.

10. Press according to claim 1, wherein said gate means includes an operating cylinder fixed inside a body connected to and perpendicular to said caisson, said gate means including a gate movable into a corresponding aperture of the caisson.

11. Press according to claim 1, wherein said fixed plate is provided with a shell means for holding residual material to be pressed or liquid escaping from the cases.

* * * * *